US007462033B2

(12) United States Patent
Xie

(10) Patent No.: US 7,462,033 B2
(45) Date of Patent: Dec. 9, 2008

(54) LIGHTER WITH REPLACEABLE FUEL CARTRIDGE

(76) Inventor: Yiling Xie, 900 Arcadia Ave., Suite 8, Arcadia, CA (US) 91007

( * ) Notice: Subject to any disclaimer, the term of this patent is extended or adjusted under 35 U.S.C. 154(b) by 344 days.

(21) Appl. No.: 11/197,049

(22) Filed: Aug. 3, 2005

(65) Prior Publication Data

US 2005/0266364 A1 Dec. 1, 2005

Related U.S. Application Data

(63) Continuation-in-part of application No. 10/102,403, filed on Mar. 19, 2002, now Pat. No. 6,945,771.

(51) Int. Cl.
*F23Q 2/42* (2006.01)

(52) U.S. Cl. ..... 431/142; 431/344; 431/255; 431/150; 431/273

(58) Field of Classification Search ..... 431/143, 431/142, 152, 131, 132, 130, 129, 150, 146, 431/255, 277, 344, 138, 139, 144, 273
See application file for complete search history.

(56) References Cited

U.S. PATENT DOCUMENTS 2,626,517 A * 1/1953 Ward ..... 431/131
2,692,493 A * 10/1954 Hepburn ..... 431/142
2,710,533 A * 6/1955 Fischer et al. ..... 431/138
2,736,181 A * 2/1956 Seibert et al. ..... 431/143
3,280,597 A * 10/1966 McLarty ..... 431/130
3,961,876 A * 6/1976 Chernock ..... 431/344
4,181,493 A * 1/1980 Piffath et al. ..... 431/344
4,416,612 A * 11/1983 Tabata ..... 431/131
5,310,336 A * 5/1994 Segawa ..... 431/131
5,460,521 A * 10/1995 Tsai ..... 431/255

FOREIGN PATENT DOCUMENTS

JP 52-45459 A * 4/1977

* cited by examiner

*Primary Examiner*—Steven B McAllister
*Assistant Examiner*—Sarah Suereth
(74) *Attorney, Agent, or Firm*—Raymond Y. Chan; David and Raymond Patent Firm

(57) ABSTRACT

A lighter incorporates with a fuel supply arrangement which includes a replaceable fuel cartridge detachably received in a receiving cavity of a casing for storing a liquefied fuel, and a gas releasable valve extended from the replaceable fuel cartridge for controlling a flow of gas from the replaceable fuel cartridge. Therefore, a user is able to refill the fuel by simply replacing a used replaceable fuel cartridge with a new replaceable fuel cartridge which is fully pre-filled with fuel.

16 Claims, 10 Drawing Sheets

LIGHTER WITH REPLACEABLE FUEL CARTRIDGE

CROSS REFERENCE OF RELATED APPLICATION

This is a Continuation-In-Part application of a non-provisional application having an application Ser. No. 10/102,403 and a filing date of Mar. 19, 2002 now U.S. Pat. No. 6,945,771.

BACKGROUND OF THE PRESENT INVENTION

1. Field of Invention

The present invention relates to a lighter, and more particularly to a lighter with a replaceable fuel cartridge, wherein the lighter is adapted for replacing an empty fuel cartridge with a full fuel cartridge so as to maximize and extend the life span of the lighter while being cost effective.

2. Description of Related Arts

A lighter is common tool that replaces matches for igniting cigarettes and cigars. Generally, there are two types of lighters, namely the regular lighter that produces visible flame and the torch lighter that produces torch. No matter which type of lighter is used, the lighter must comprise a liquefied fuel storage for supplying fuel in order to provide the visible flame or the torch.

A conventional liquefied fuel storage has a releasable valve communicating with a nozzle and a refill valve adapted for filling a fuel therethrough in such a manner that when the lighter is used up its fuel, a user is able to refill the fuel by means of a filling bottle.

It is known that the fuel is a gas form in a normal condition and in a liquid form when it is stored in the liquefied fuel storage of the lighter under a high pressure. In order to refill the fuel, the refill valve must be fit into a tip of the filling bottle such that the filling bottle provides a high pressure to transfer the fuel to the liquefied fuel storage through the refill valve. However, during filling operation, the fuel may leak at the tip of the filling bottle. It is extremely dangerous because the fuel is a flammable mixture such as butane, especially when refuel the lighter in the kitchen near the sink or pilot light.

Thus, it is difficult to prevent the leak of the fuel during filling operation such that the user may inhale the leaking fuel, which is harmful to the user's health.

Moreover, the user is unable to determine whether the liquefied fuel storage is fully filled with fuel such that the user may keep refilling the fuel to the liquefied fuel storage even though it is full. As a result, the excess fuel will be spilled out through the tip of the filling bottle, which is a waste of fuel. Besides, it is hassle for the user to carry the filling bottle everywhere.

SUMMARY OF THE PRESENT INVENTION

A main object of the present invention is to provide a lighter with a replaceable fuel cartridge, wherein the lighter is adapted for replacing an empty fuel cartridge with a full fuel cartridge so as to maximize and extend the life span of the lighter while being cost effective.

Another object of the present invention to provide a lighter with a replaceable fuel cartridge, wherein the fuel cartridge is sealedly mounted to nozzle of the lighter so as to prevent the leakage of the fuel released from the fuel cartridge to the nozzle.

Another object of the present invention is to provide a lighter with a replaceable fuel cartridge, wherein lighter provides a "plug and light" replacement operation of the fuel cartridge such that the user is able to lighten the lighter simply by plugging a new and full fuel cartridge.

Another object of the present invention is to provide a lighter with a replaceable fuel cartridge, wherein the lighter is refilled by replacing the fuel cartridge so as to ensure the lighter is fully pre-filled with fuel after the new fuel cartridge is replaced.

Accordingly, in order to accomplish the above objects, the present invention provides a lighter, comprising:

a casing having a receiving cavity and an opening communicating the receiving cavity with outside;

a gas emitting nozzle appearing at a ceiling of the casing;

a fuel supply arrangement, comprising:

a replaceable fuel cartridge detachably received in the receiving cavity through the opening for storing a liquefied fuel;

a gas releasable valve extended from the replaceable fuel cartridge for controlling a flow of gas from the replaceable fuel cartridge; and a lever arm, which is supported in the casing in a pivotally movable manner, having an actuating end coupling with the gas releasable valve and a driving end arranged to pivotally move the actuating end for releasing the fuel in the replaceable fuel cartridge to the gas emitting nozzle through the gas releasable valve; and an ignition system supported by the casing for producing a spark toward the gas emitting nozzle to ignite the gas emitted from the gas emitting nozzle.

These and other objectives, features, and advantages of the present invention will become apparent from the following detailed description, the accompanying drawings, and the appended claims.

DETAILED DESCRIPTION OF THE PREFERRED EMBODIMENT

Figure 1:
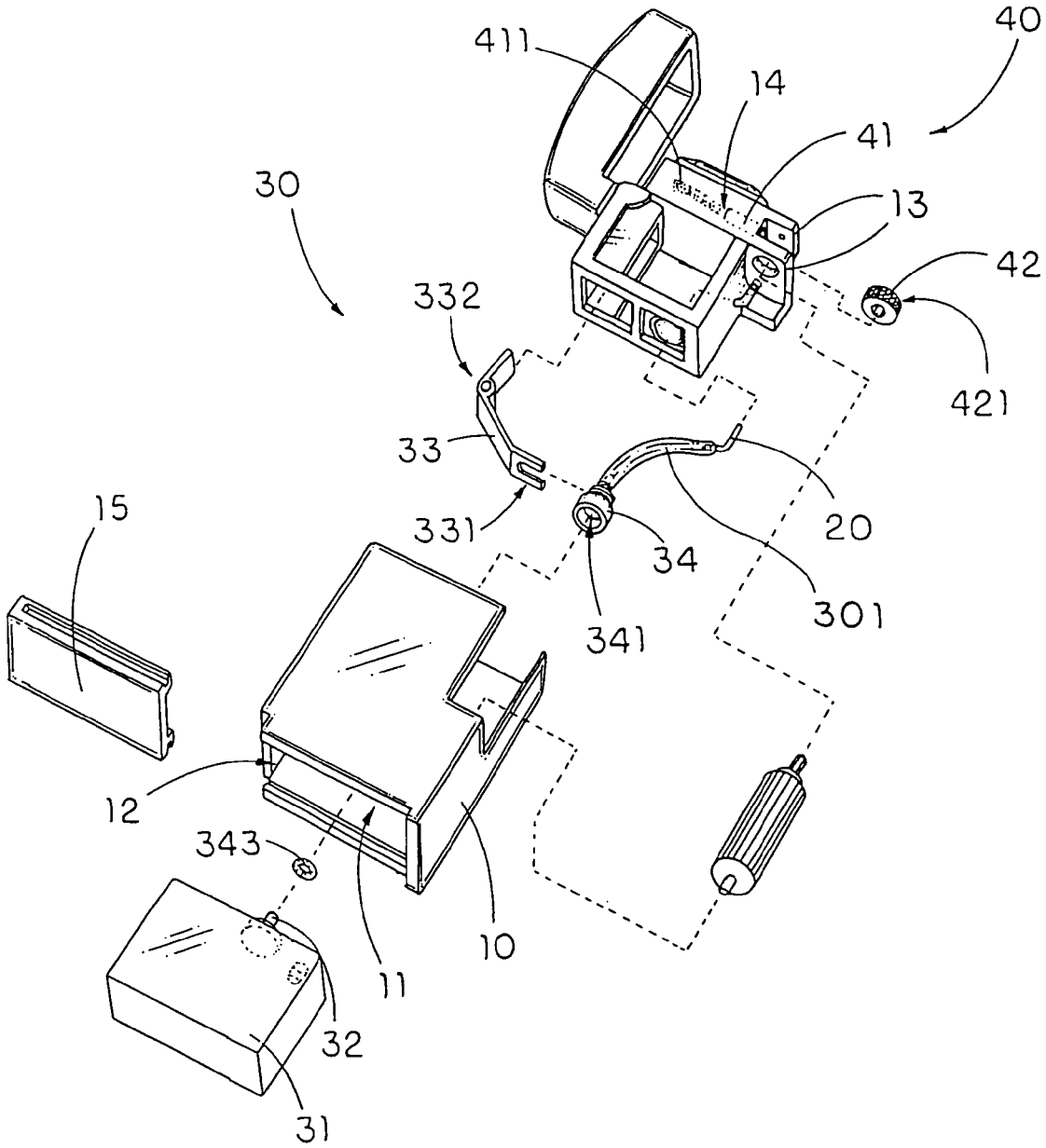
FIG. 1 is an exploded perspective view of a lighter with a replaceable fuel cartridge according to a first preferred embodiment of the present invention.
Figure 2:
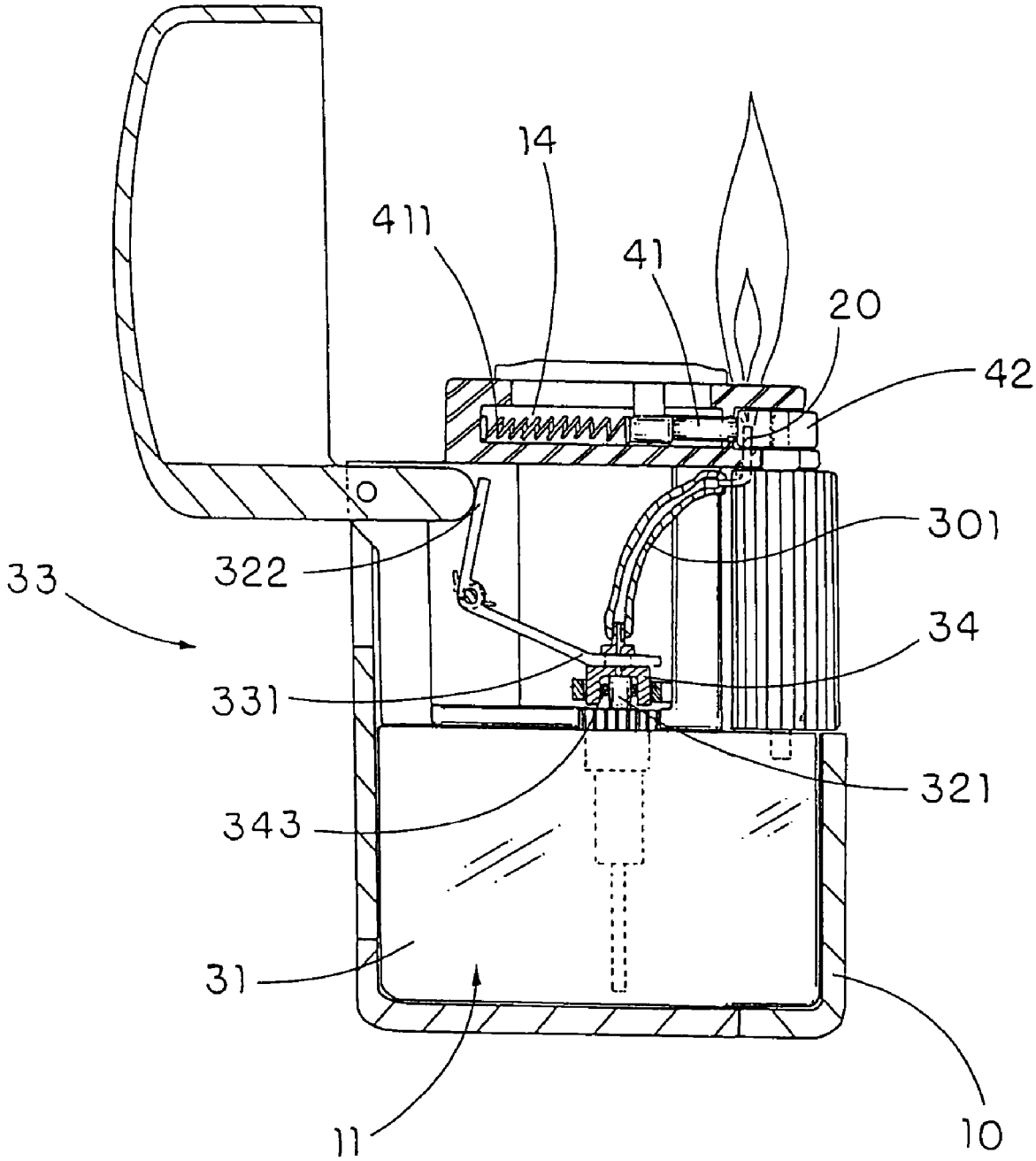
FIG. 2 is a sectional view of the lighter with the replaceable fuel cartridge according to the above first preferred embodiment of the present invention.

Referring to FIG. 1 of the drawings, a lighter according to a first preferred embodiment of the present invention is illustrated, wherein the lighter, such as a conventional lighter, comprises a casing 10 having a receiving cavity 11 and an opening 12 communicating the receiving cavity with outside and a gas emitting nozzle 20 appearing at a ceiling of the casing 10. The lighter further comprises a fuel supply arrangement 30 and an ignition system 40.

The fuel supply arrangement 30 comprises a replaceable fuel cartridge 31 detachably received in the receiving cavity 11 through the opening 12 for storing a liquefied fuel, a gas releasable valve 32 extended from the replaceable fuel cartridge 31 for controlling a flow of gas from the replaceable fuel cartridge 31 to the gas emitting nozzle 20 through a flexible gas tube 301, and a lever arm 33, which is supported in the casing 10 in a pivotally movable manner, having an actuating end 331 coupling with the gas releasable valve 32 and a driving end 332 arranged to pivotally move the actuating end 331 for releasing the fuel in the replaceable fuel cartridge to the gas emitting nozzle 20 through the gas releasable valve 32. Accordingly, the flexible gas tube 301 can distribute the pulling or pushing force at the replaceable fuel cartridge 31 during the replacement thereof to prevent an unwanted movement of the gas emitting nozzle 20.

The ignition system 40 is supported by the casing 10 for producing a spark toward the gas emitting nozzle 20 to ignite the gas emitting from the gas emitting nozzle 20.

According to the preferred embodiment, the lighter is embodied to be a flint-type lighter wherein the casing 10 comprises a pair of supporting walls 13 provided on a ceiling of the casing 10, and a flint housing 14 provided on the ceiling of the casing 10 between the two supporting walls 11. The casing 10 further comprises a door 15 slidably mounted at a bottom portion of the casing 10 at the opening 12 in a detachably movable manner for enclosing the receiving cavity 11 so as to support the replaceable fuel cartridge 31 therein.

Figure 4:
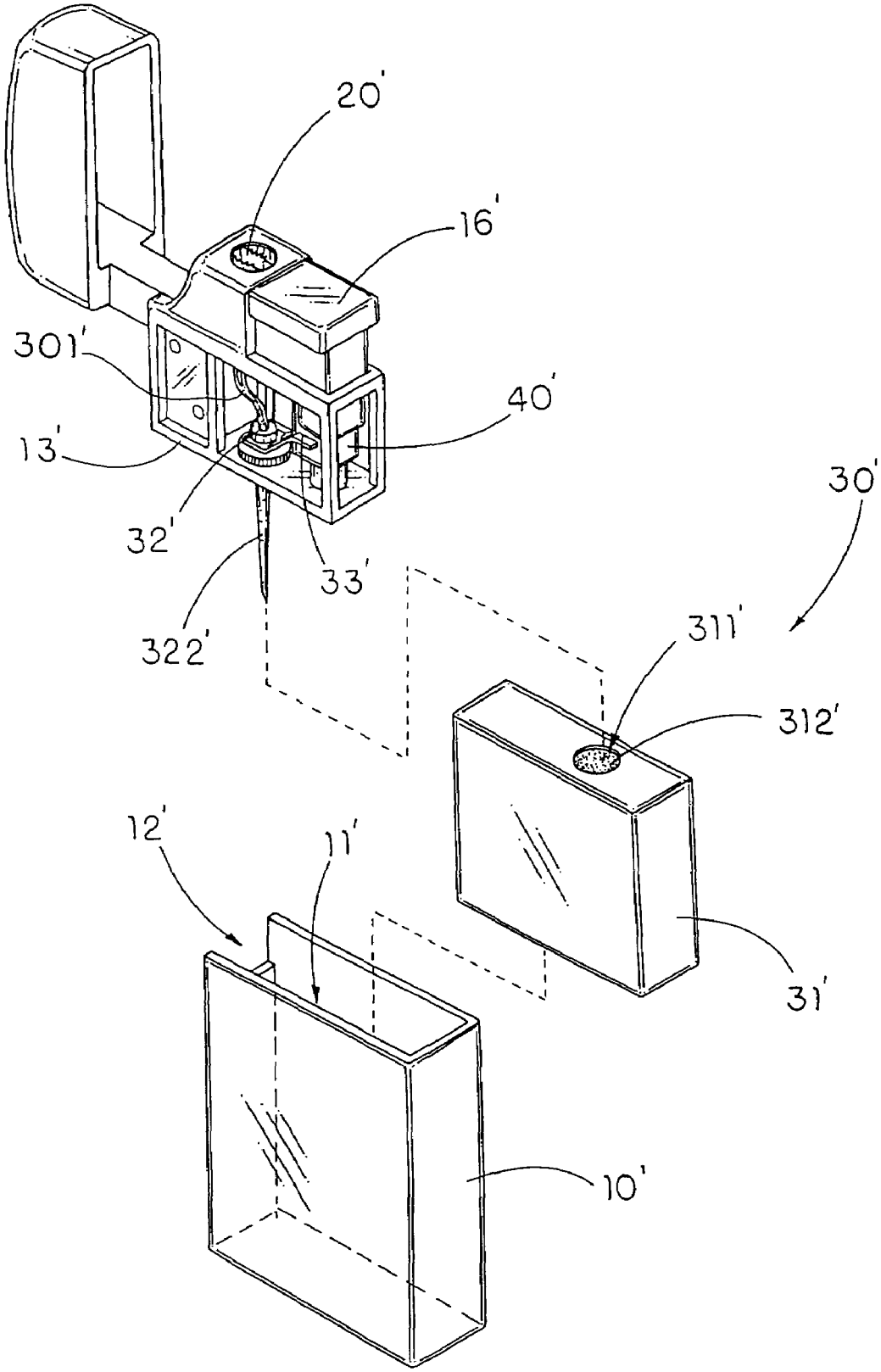
FIG. 4 is an exploded perspective view of a lighter with a replaceable fuel cartridge according to a second preferred embodiment of the present invention.

The gas emitting nozzle 20, according to the preferred embodiment, is a gas nozzle for producing a visible flame. However, the gas emitting nozzle 20 is adapted to be constructed as a torch nozzle to produce a torch, as shown in FIG. 4.

The ignition system 40, which is embodied to be a flint type ignition system, comprises a flint 41 supported by the casing 11 and a striker wheel 42 having a circumferential coarse striking surface 421 positioned in contact with the flint 41.

The flint 41 is retained urging against the striking surface of the striker wheel 42 for producing sparks directed toward the gas emitting nozzle 20 when the striking surface is driven to strike against the flint 41, such that the gas emitted from the gas emitting nozzle 20 is ignited.

The flint 41 is supported by a flint-spring 411 wherein the flint 41 and the flint-spring 411 are received in the flint housing 14. The striker wheel 42 is rotatably supported between the two supporting walls 13 wherein the flint 31 is retained urging against the striking surface of the striker wheel 42 by means of the flint-spring 411 for producing the sparks directed toward the gas emitting nozzle 20 when the striker wheel 42 is rotatably driven to strike against the flint 31.

The replaceable fuel cartridge 31 is fully pre-filled with fuel therein wherein the fuel is stored in the replaceable fuel cartridge 31 in a liquefied form under a predetermined pressure and is released through the gas releasable valve 31 as a gas form toward the gas emitting nozzle 20.

The gas releasable valve 32 is sealedly mounted to the replaceable fuel cartridge 31 to communicate with the fuel in the replaceable fuel cartridge 31 in such a manner that the replaceable fuel cartridge 31 with the gas releasable valve 32 is detachably mounted in the casing 10.

Figure 3A:
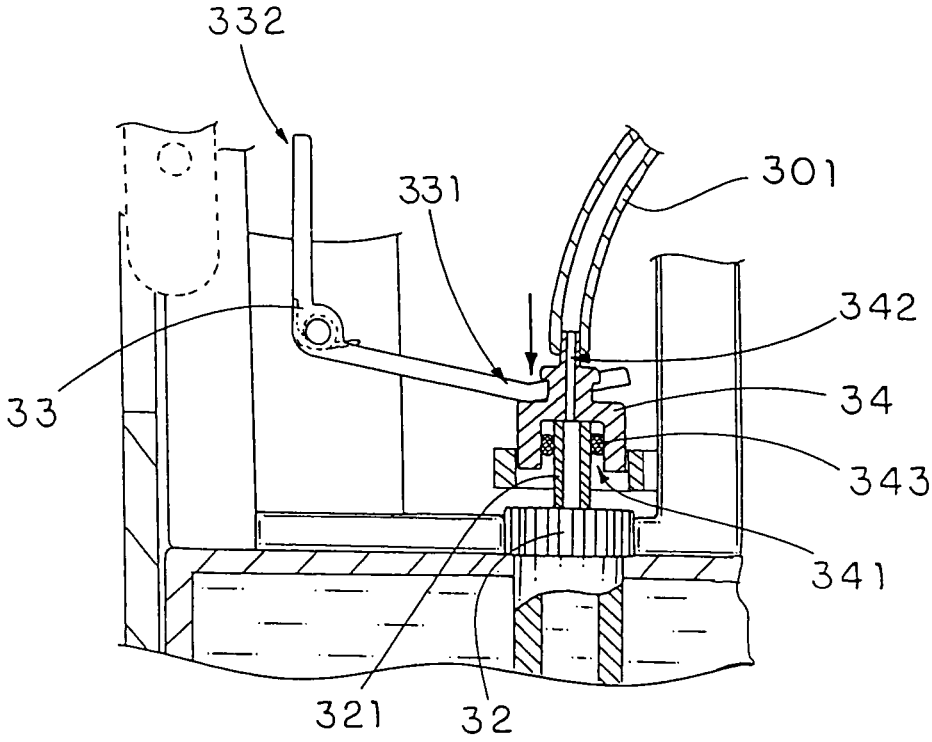
FIG. 3A is a partially sectional view of the lighter with the replaceable fuel cartridge according to the above first preferred embodiment of the present invention, illustrating the gas releasing valve in a closed position.

The gas releasable valve 32 has a movable operating tip 321 extended upwardly, wherein when the movable operating tip 321 is depressed downwardly, the gas releasable valve 32 releases the fuel from the replaceable fuel cartridge 31. Accordingly, the gas releasable valve 32 is arranged to release the fuel from the replaceable fuel cartridge 31 to the gas emitting nozzle 20 when the driving end 332 of the lever arm 32 is driven upwardly, so as to depress the movable operating tip 321 of the gas releasable valve 32 downwardly by the actuating end 331 of the lever arm 33. In other words, the movable operating tip 321 of the gas releasable valve 32 is normally in an upper closed position, as shown in FIG. 3A, and is arranged to release the fuel from the replaceable fuel cartridge 31 to gas emitting nozzle 20 when the movable operating tip 321 of the gas releasable valve 32 is driven at a lower open position, as shown in FIG. 3B.

Figure 3B:
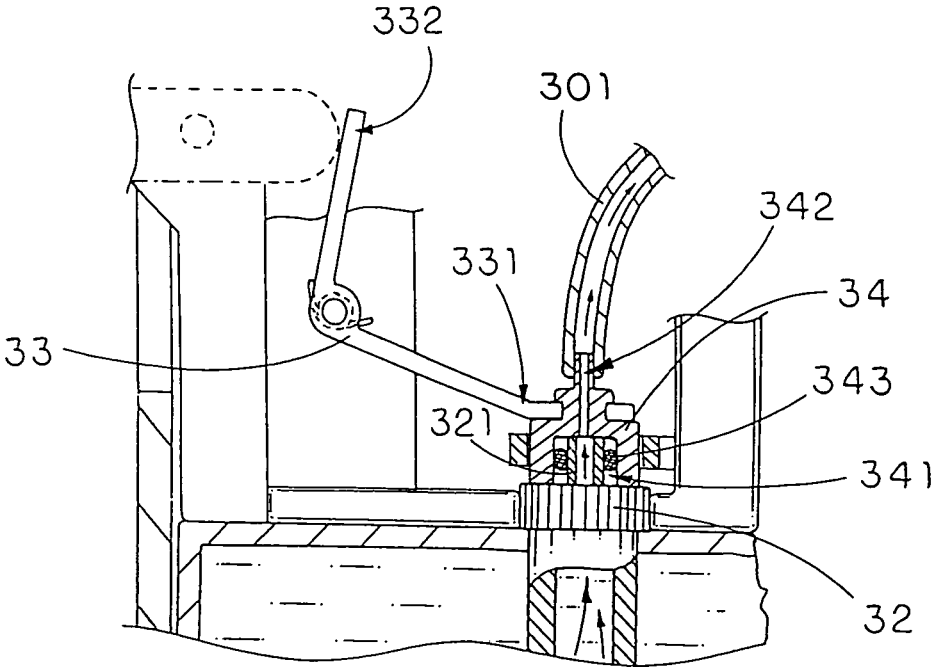
FIG. 3B is a partially sectional view of the lighter with the replaceable fuel cartridge according to the above first preferred embodiment of the present invention, illustrating the gas releasing valve releasing the fuel from the replaceable fuel cartridge by the lever arm.

The fuel supply arrangement 30 further comprises an actuating cap 34 engaged with the actuating end 331 of the lever arm 33 wherein the actuating cap 34 has an interior chamber 341 to detachably fit the movable operating tip 321 of the gas releasable valve 32 therein and a guiding through slot 342 extended from the interior chamber 341 and aligned with the movable operating tip 321 of the gas releasable valve 32 for transferring the gas from the gas releasable valve 32 to the gas emitting nozzle 20 in such a manner that when the actuating end 331 of the lever arm 33 drives the actuating cap 34 downwardly to depress the movable operating tip 321 of the gas releasable valve 32, the gas releasable valve 32 is arranged to release the fuel from the replaceable fuel cartridge 31 to the gas emitting nozzle 20 through the guiding through slot 342, as shown in FIG. 3B.

The actuating cap 34 further comprises a sealing member 343 having a ring-shaped coaxially mounted in the interior chamber 341 to sealedly mount the movable operating tip 321 of the gas releasable valve 32, so as to prevent a gas leakage from the actuating cap 34. Accordingly, the sealing member 343, which is preferably made of a deforming material such as rubber, is sealedly sandwiched between an inner wall of the interior chamber 341 and an outer wall of the movable operating tip 321 of the gas releasable valve 32, as shown in FIG. 3. Therefore, when replacing a new replaceable fuel cartridge 31, the sealing member 343 is adapted to sealedly fill up a gap between the inner wall of the interior chamber 341 and the outer wall of the movable operating tip 321 of the gas releasable valve 32, so that the fuel released from the replaceable fuel cartridge 31 will be totally transferred to the gas emitting nozzle 20 through the guiding through slot 342 and no fuel is leaked out from the actuating cap 34 around the gas releasing valve 32.

Referring to FIG. 4, a second embodiment of the lighter illustrates an alternative mode of the first embodiment, wherein the lighter, according to the second embodiment, comprises a casing 10' having a receiving cavity 11' and an opening 12' communicating the receiving cavity with outside and a gas emitting nozzle 20' appearing at a ceiling of the casing 10'. The lighter further comprises a fuel supply arrangement 30' and an ignition system 40'.

The fuel supply arrangement 30' comprises a replaceable fuel cartridge 31' detachably received in the receiving cavity 11' through the opening 12' for storing a liquefied fuel, a gas releasable valve 32' extended from the replaceable fuel cartridge 31 for controlling a flow of gas from the replaceable fuel cartridge 31' to the gas emitting nozzle 20' through a flexible gas tube 301', and a lever arm 33', which is supported in the casing 10' in a pivotally movable manner, having an actuating end 331' coupling with the gas releasable valve 32' and a driving end 332' arranged to pivotally move the actuating end 331' for releasing the fuel in the replaceable fuel cartridge to the gas emitting nozzle 20' through the gas releasable valve 32'. Accordingly, the flexible gas tube 301' can distribute the pulling or pushing force at the replaceable fuel cartridge 31' during the replacement thereof to prevent an unwanted movement of the gas emitting nozzle 20'.

The ignition system 40' is supported by the casing 10 for producing a spark toward the gas emitting nozzle 20' to ignite the gas emitting from the gas emitting nozzle 20'.

According to the second embodiment, the casing 10' further comprises a supporting platform 13' rigidly supported in the casing 10' wherein the gas releasable valve 32' is substantially supported on the supporting platform 13' to communicate with the gas emitting nozzle 20'.

The ignition system 40, which is a piezoelectric type ignition system, comprises a piezoelectric unit 41', which is disposed in the casing 10' for generating piezoelectricity, comprising a movable operating part 42' extended upwardly and an ignition tip 43' extended to a position closed to the gas emitting nozzle 20', wherein when the movable operating part 42' of the piezoelectric unit 40' is depressed downwardly, the ignition tip 43' generates sparks to ignite the gas emitted from the gas emitting nozzle at the same time.

Accordingly, a pusher button 16' is mounted on the ceiling of the casing 10' in a vertically movable manner wherein the pusher button 16' is positioned to a top end of the movable operating part 42' of the piezoelectric unit 41' and attached to the driving end 332' of the lever arm 33' in such a manner that when the pusher button 16' is depressed downwardly, the movable operating part 42' of the piezoelectric unit 41' is compressed and fuel from the replaceable fuel cartridge 31' to the gas emitting nozzle 20', so as to ignite the lighter.

It is worth to mention that the ignition system 40, 40' according to the first and second embodiments are interchangeable. In other words, it is obvious that the first embodiment can be incorporated with the piezoelectric ignition system and the second embodiment can be incorporated with the flint type ignition system without affecting the ignition of the gas emitted from the gas emitting nozzle 20, 20'.

Figure 6:
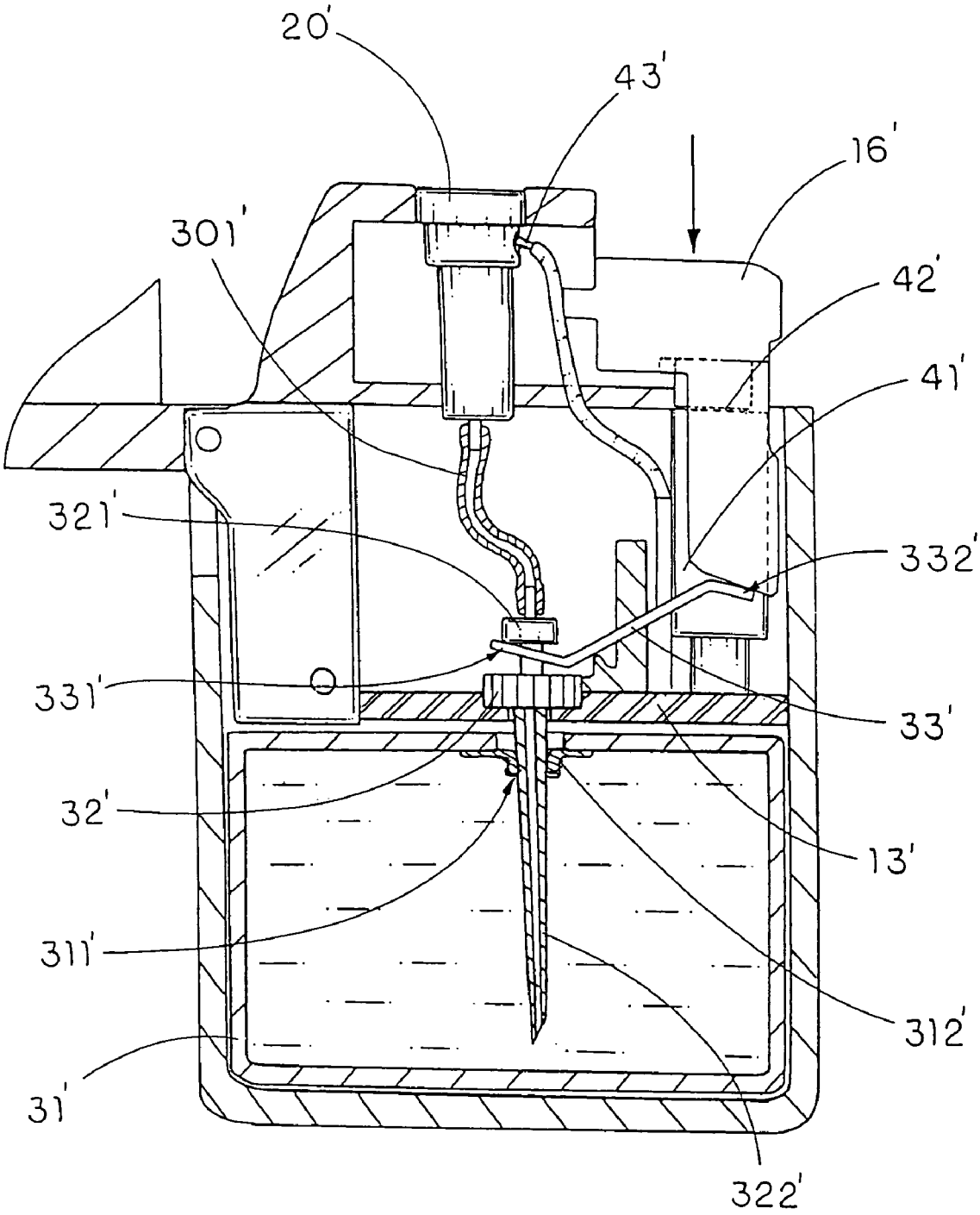
FIG. 6 is a partially sectional view of the lighter with the replaceable fuel cartridge according to the above second preferred embodiment of the present invention, illustrating the gas releasing valve releasing the fuel from the replaceable fuel cartridge by the lever arm.
Figure 7:
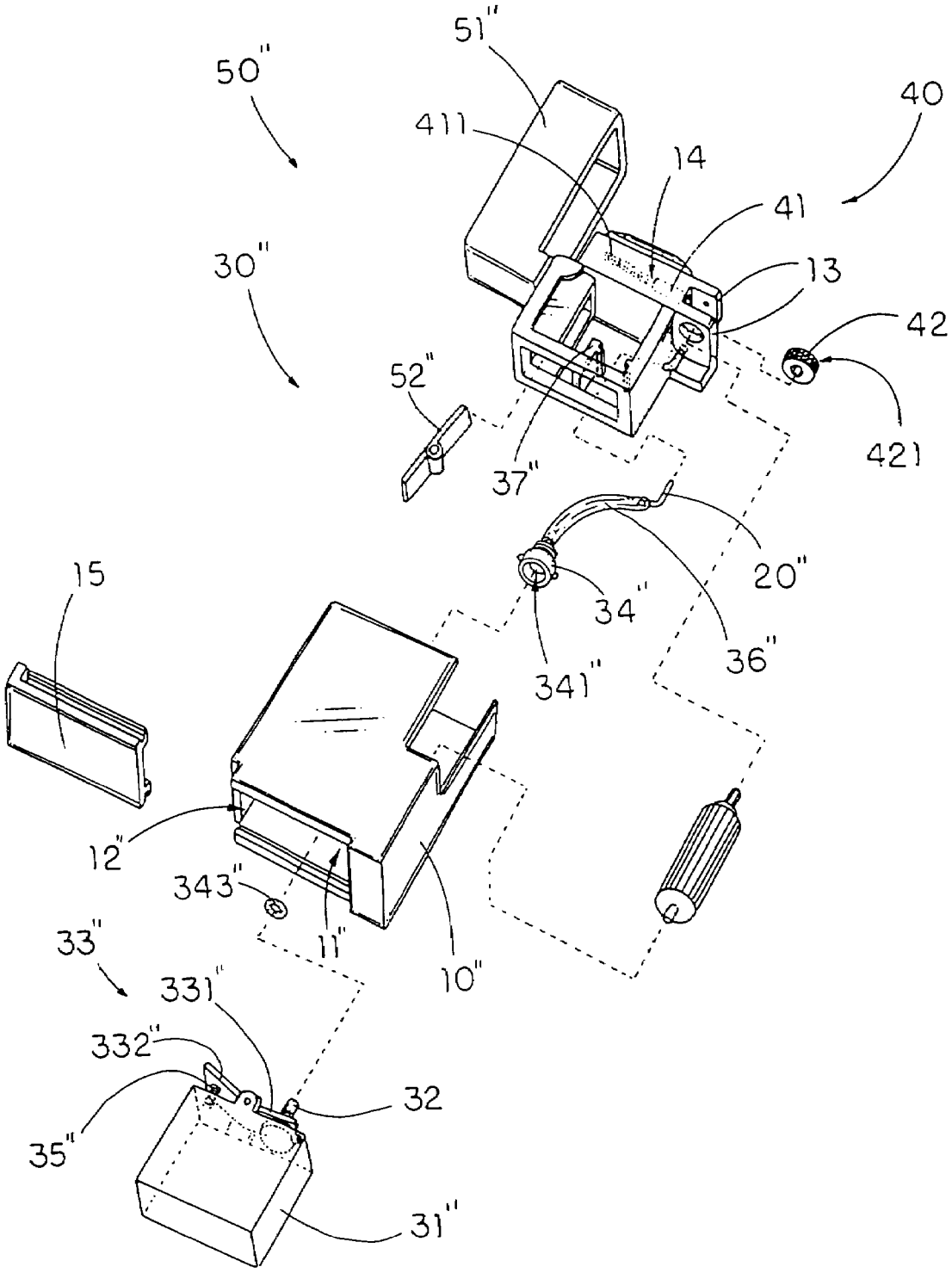
FIG. 7 is a perspective view of the lighter with replaceable fuel cartridge according to a third preferred embodiment of the present invention.

As shown in FIG. 4, the gas releasable valve 32' is substantially supported in the casing 10' to communicate with the replaceable fuel cartridge 31' wherein the gas releasable valve 32' has a movable operating tip 321' extended upwardly and is engaged with the actuating end 331' of the lever arm 33'. When the movable operating tip 321' is lifted upwardly, the gas releasable gas 32' releases the fuel from the replaceable fuel cartridge 31'. Accordingly, the gas releasable valve 32' is arranged to release the fuel from the replaceable fuel cartridge 31' to the gas emitting nozzle 20' when the driving end 332' of the lever arm 32' is driven downwardly, so as to lift up the movable operating tip 321' of the gas releasable valve 32' by the actuating end 331' of the lever arm 33', as shown in FIG. 6.

The gas releasable valve 32' further comprises a tubular inserting adapter 322' extended downwardly and arranged to insert into the replaceable fuel cartridge 31' for releasing the fuel therein to the movable operating tip 321'.

Figure 5:
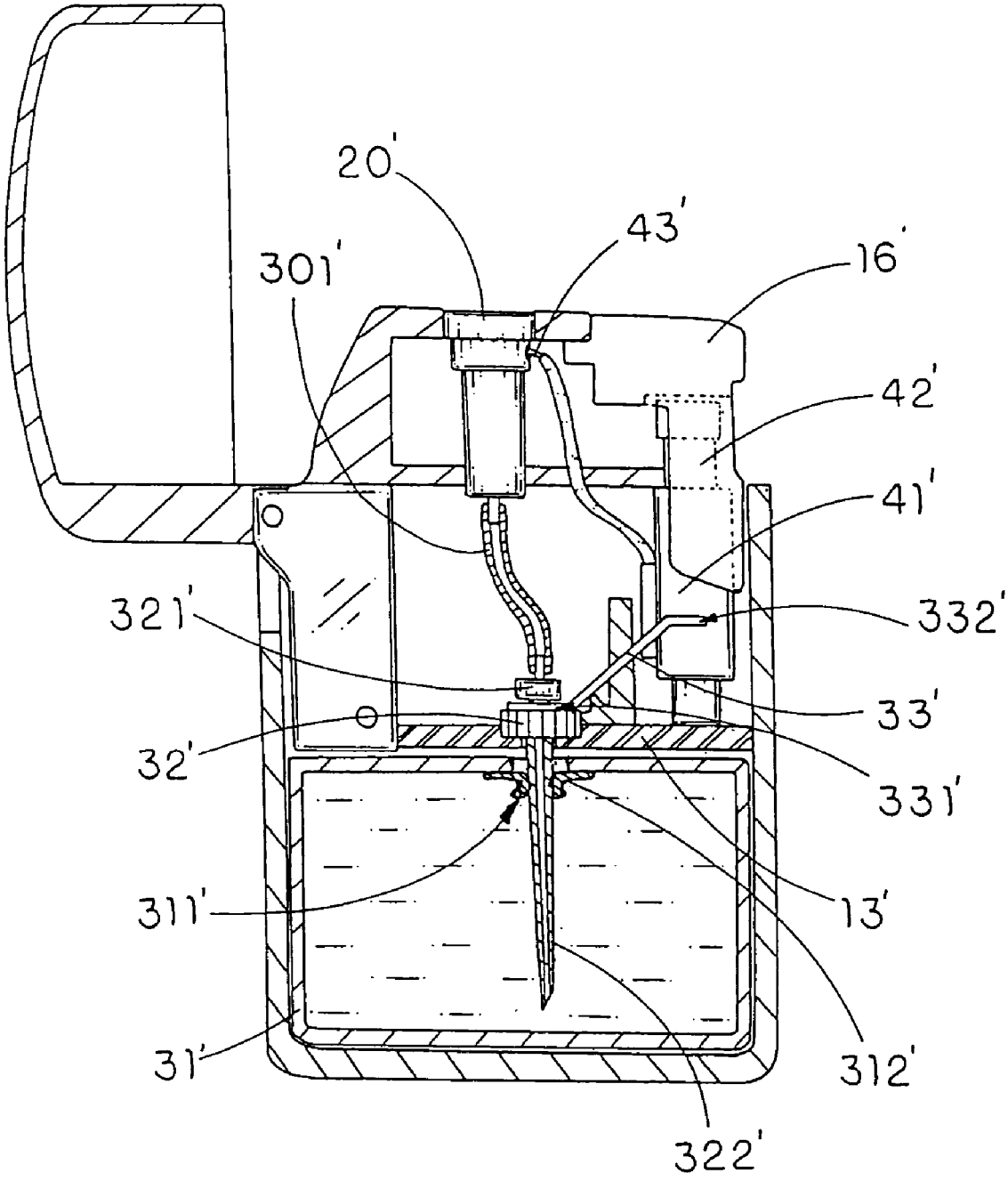
FIG. 5 is a sectional view of the lighter with the replaceable fuel cartridge according to the above second preferred embodiment of the present invention.

The replaceable fuel cartridge 31' is detachably mounted to the gas releasable valve 32' wherein the replaceable fuel cartridge 31' has a fuel outlet 311' for the inserting adapter 322' sealedly inserting therein so as to guide the fuel in the replaceable fuel cartridge 31' to the movable operating tip 321' of the gas releasable valve 32'. The replaceable fuel cartridge 31' further has a sealing layer 312' sealedly mounted to the fuel outlet 311' for sealedly enclosing the fuel in the replaceable fuel cartridge 31'. Accordingly, the inserting adapter 322' has a tapered end adapted to penetrate through the sealing layer 312' into the replaceable fuel cartridge 31'. It is worth to mention that the sealing layer 312', which is made of deforming material such as rubber, having a predetermined thickness, is adapted to seal up an outer wall of the inserting adapter 322' within the fuel outlet 311' so as to prevent the gas leakage from the fuel outlet 311' after the inserting adapter 322' is inserted into the replaceable fuel cartridge 31' through the fuel outlet 311', as shown in FIG. 5.

Referring to FIG. 7 to FIG. 10, the lighter according to a third embodiment of the present invention is illustrated. The lighter comprises a casing 10" having a receiving cavity 11" and an opening 12" communicating the receiving cavity 11" with outside and a gas emitting nozzle 20" appearing at a ceiling of the casing 10". The lighter further comprises a fuel supply arrangement 30" and an ignition system 40".

The fuel supply arrangement 30" comprises a replaceable fuel cartridge 31" detachably received in the receiving cavity 11" through the opening 12" for storing a liquefied fuel, a gas releasable valve 32" extended from the replaceable fuel cartridge 31" and coupling with the gas emitting nozzle 20" for controlling a flow of gas from the replaceable fuel cartridge 31".

The fuel supply arrangement 30" further comprises a gas releasing lever 33", which is pivotally mounted on the replaceable fuel cartridge 31", coupling to the gas releasable valve 32" for managing an operation of the gas releasable valve 32".

Preferably, the gas releasing lever 33" is embodied as a lever arm pivotally extended from the gas releasable valve 32" and probed into the receiving cavity 11" in such a manner that after the replaceable fuel cartridge 31" is inserted into the receiving cavity 11", the gas releasing lever 33" is disposed in the casing 10" with a pivotally moveable manner. That is to say, the gas releasing lever 33" has an actuating end 331" coupled with the gas releasable valve 32" for shifting a movement of the gas releasable valve 32", and a driving end 332" extended into the casing 10" in such a manner that by depressing the driving end 332", the actuating end 331" is capable of being lifted to shift the gas releasable valve 32".

Accordingly, the light according to the third preferred embodiment of the present invention further comprises a gas releasing arrangement 50" supported within the casing 10"

for operating the gas releasing lever 33" into action. The gas releasing arrangement 50" comprises an actuator to depress the driving end 332" of the gas releasable valve 32".

The actuator comprises a lighter cap 51" pivotally mounted to the casing 10" for enclosing the ceiling of the casing 10", and a driving lever 52" pivotally supported within the casing 10" wherein the driving lever 52" has an upper end coupling with the lighter cap 51" and a lower end slidably engaged with the driving end 332" of the gas releasing lever 33" for actuating the gas releasing lever 33" into movement. When the lighter cap 51" is pivotally and upwardly folded to expose the ceiling of the casing 10", the driving lever 52" is driven to depress the driving end 332" of the gas releasing lever 33" for releasing the gas from the replaceable fuel cartridge 51".

Figure 8:
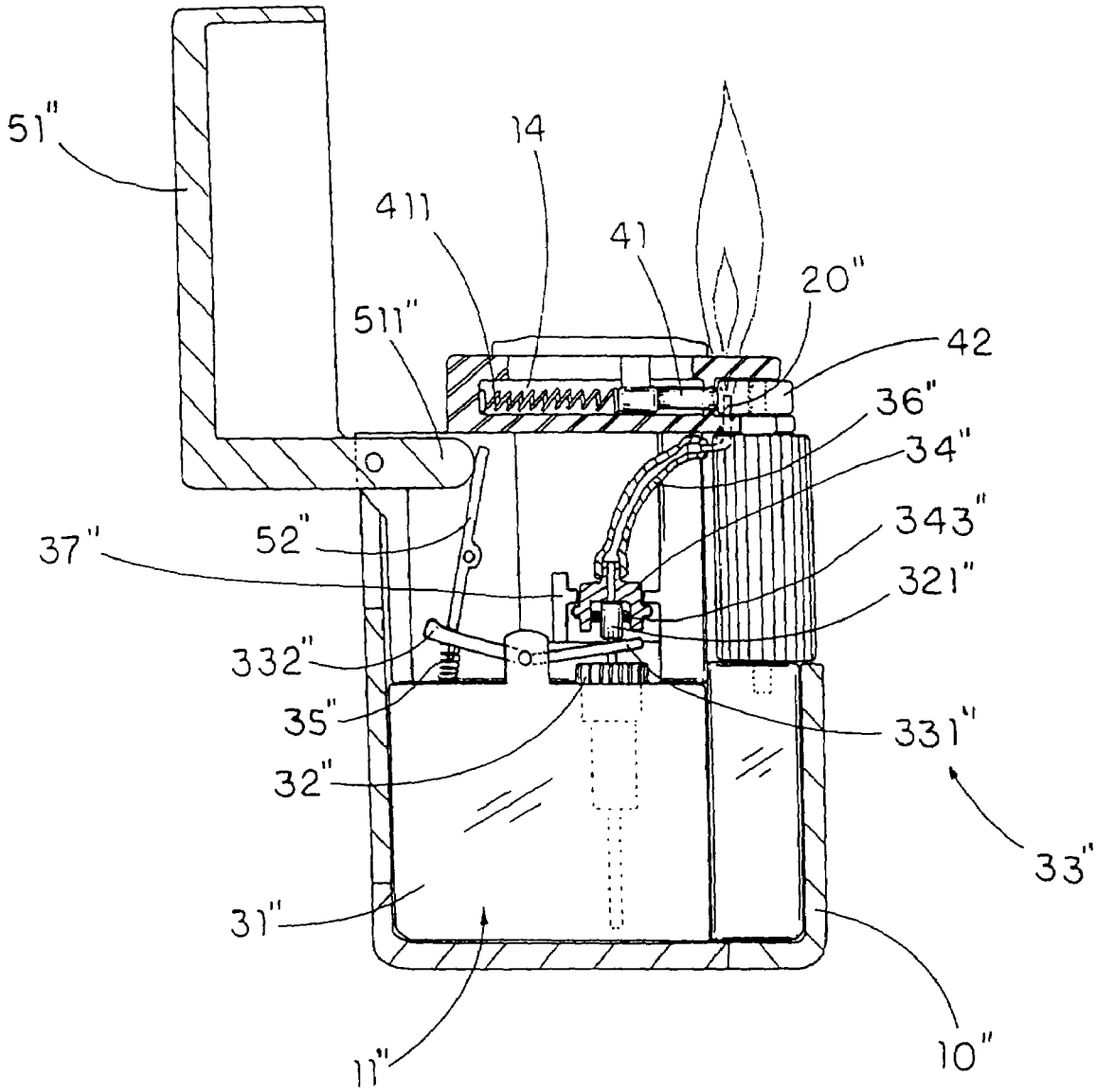
FIG. 8 is a sectional view of the lighter with replaceable fuel cartridge according to the above third preferred embodiment of the present invention.

As shown in FIG. 8, the lighter cap 51" has a pivotal end 511" pivotally moveable with respect to the casing 10". Whenever the light cap 51" is pivotally unfolded to expose the ceiling of the casing 10", the pivotal end 511" is inwardly rotated so as to slidably bias against the upper portion of the driving lever 52" thus making the driving lever 52" rotate in a clockwise manner. As a result, the outwardly rotated lower portion of the driving lever 52" will downwardly depress the driving end 332" of the gas releasing lever 33" for managing a gas flow from the gas releasable valve 32".

It is worth to mention that the actuator can be an ignition button of the lighter to couple with the driving end 332" of the gas releasing lever 33" such that when the ignition button is depressed for producing the sparks, the driving end 332" of the gas releasing lever 33" is depressed at the same time for ignition of the lighter.

Accordingly, the gas releasable valve 32" has a movable operating tip 321" extended upwardly. Whenever the movable operating tip 321" is depressed downwardly, the gas releasable valve 32" releases the fuel from the replaceable fuel cartridge 31". In the preferred embodiment, the gas releasable valve 32" is arranged to release the fuel from the replaceable fuel cartridge 31" to the gas emitting nozzle 20" when the driving end 332" of the gas releasing lever 33" is depressed.

Here, the fuel supply arrangement 30" comprises a sheltering cap 34" engaged with the gas releasable valve 32" wherein the sheltering cap 34" has an interior chamber 341" to detachably fit the movable operating tip 321" of the gas releasable valve 32" therein and a guiding through slot 342" extended from the interior chamber 341" and aligned with the movable operating tip 321" of the gas releasable valve 32" for transferring the gas from the gas releasable valve 32" to the gas emitting nozzle 20".

Figure 9:
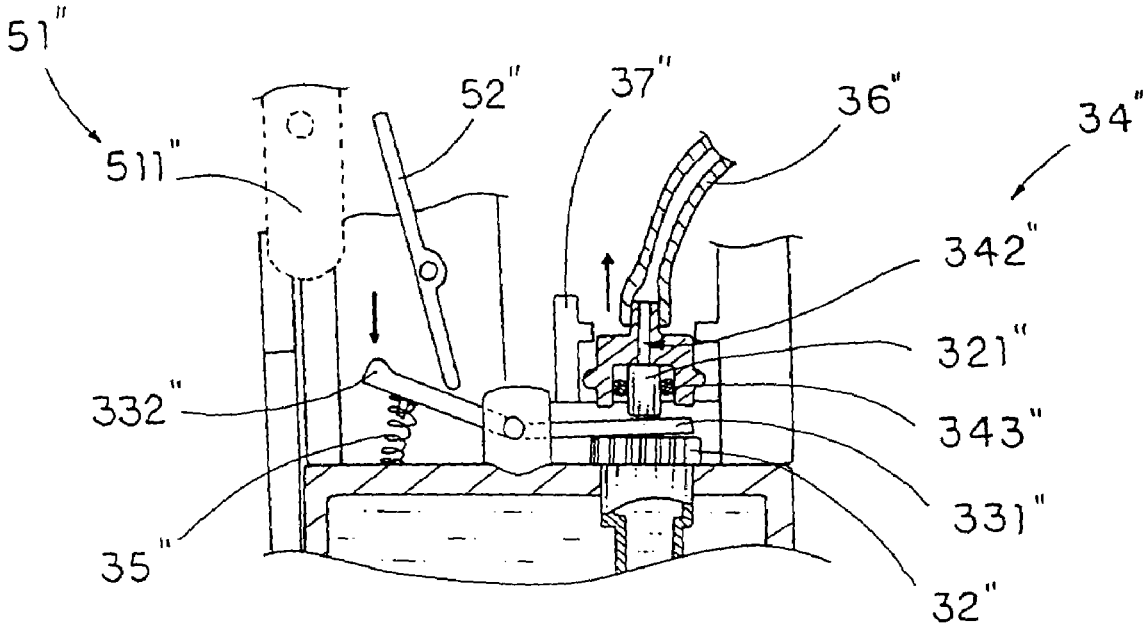
FIG. 9 is a partial sectional view of the lighter with replaceable fuel cartridge according to the above third preferred embodiment showing the moveable operating tip with a lower closed position.
Figure 10:
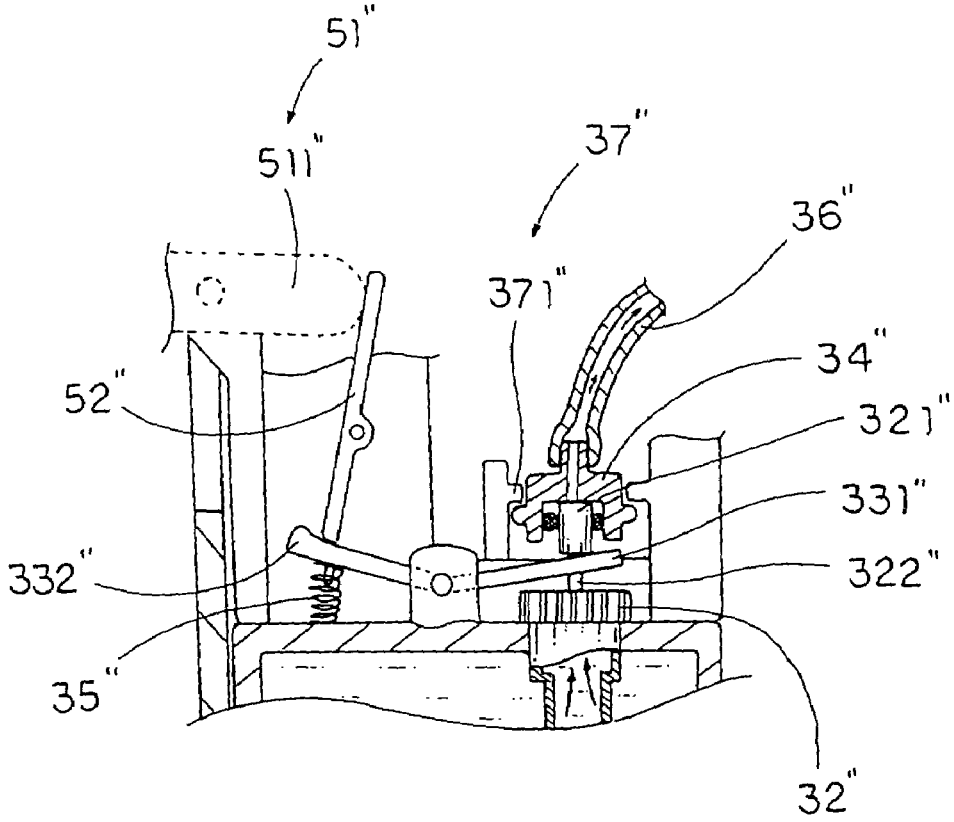
FIG. 10 is a partial sectional view of the lighter with replaceable fuel cartridge according to the above third preferred embodiment showing the moveable operating tip with an upper position.

As shown in FIG. 9, the actuating end 331" of the gas releasing lever 33" is coupled onto a neck 322" of the moveable operating tip 321", so that when the driving end 332" of the gas releasing lever 33A is downwardly depressed, the actuating end 331" is capable of being lifted up for nudging the moveable operating tip 321" biasing against the roof of the sheltering cap 34", so that the gas reserved within the replaceable fuel cartridge 31" could be released via the guiding through slot 342" to be ignited at the gas emitting nozzle 20". In other words, the movable operating tip 321" of the gas releasable valve 32" is normally in a lower closed position, as shown in FIG. 9, and is arranged to release the fuel from the replaceable fuel cartridge 31" to gas emitting nozzle 20" when the movable operating tip 321" of the gas releasable valve 32" is driven to an upper position, as shown in FIG. 10.

The sheltering cap 34" further comprises a sealing member 343" having a ring-shaped coaxially mounted in the interior chamber 341" to sealedly mount the movable operating tip 321" of the gas releasable valve 32", so as to prevent a gas leakage from the sheltering cap 34".

It is noted that replaceable fuel cartridge 31" further comprises means for applying an urging force against the gas releasing lever 33" to push the actuating end 331" thereof downwardly. The urging means comprises a resilient element 35" supported by the casing 10" and disposed below the driving end 332" for continuously biasing against the driving end 332". As a result, under normal circumstance, the driving end 332" is upwardly biased for ensuring the moveable operating tip 321" rested in the close position.

Moreover, the sheltering cap 34" is directly coupled a gas transferring conduit 36" having another end serviceable to the gas emitting nozzle 20". It is worth to mention that the gas transferring conduit 36" is a flexible gas tube, such as rubber, allowing the gas to flow towards the gas emitting nozzle 20" when the sheltering cap 34" is pushed upwardly so that during the gas releasing process, the sheltering cap 34" is capable of freely lead the gas transferring conduit 36" moving with the casing 10". Preferably, the fuel supply arrangement 30" further comprises two guiding wall 37" supported within the casing 10" wherein the sheltering cap 34" is slidably mounted between the guiding walls 37" such that the guiding walls 37" guide a movement of the sheltering cap 34" within a predetermined vertical distance. As shown in FIG. 9 and FIG. 10, each of the guiding walls 37" has a transverse stopper ridge 371" integrally and inwardly defined thereon, so that when the moveable operating tip 321" is lifted up forcing the sheltering cap 34" upwardly displaced, the stopper ridge 371" will automatically limit the moving distance of the sheltering cap 34".

Preferably, the sheltering cap 34" has a cap shoulder 344" circularly projected from an outer wall of the sheltering cap 34". As a result, when the moveable operating tip 321" is lifted up nudging the sheltering cap 34" upwardly shifted along the two guiding wall 37", and then the stopper ridge 371" inwardly extended from the guiding wall 37" would be biased against the upwardly proceeding cap shoulder 344" thus blocking any further upward movement of the sheltering cap 34".

Figure 11:
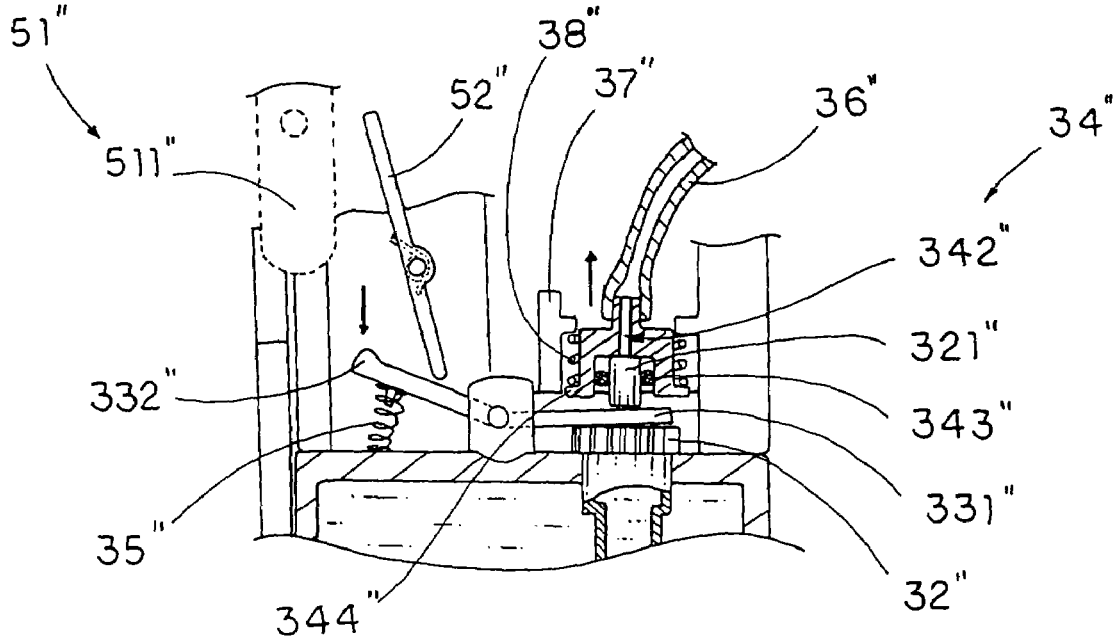
FIG. 11 is a partial sectional view of the lighter with replaceable fuel cartridge according to the above third preferred embodiment showing a resilient member is disposed between a stopper ridge and a cap shoulder.
Figure 12:
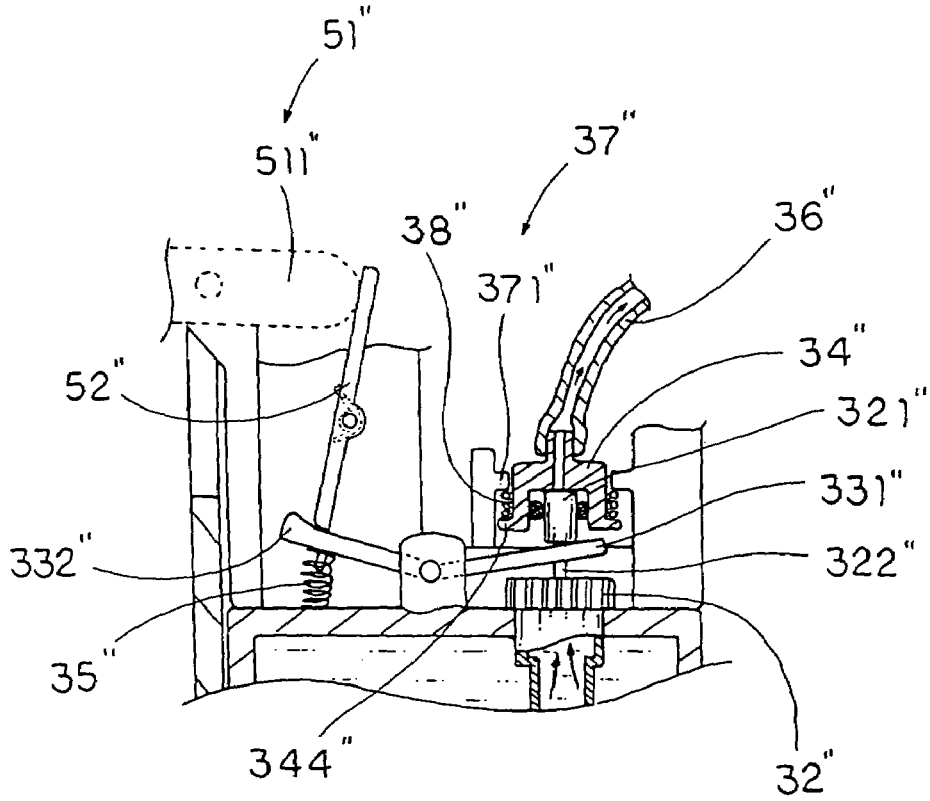
FIG. 12 is a partial sectional view of the lighter with replaceable fuel cartridge according to the above third preferred embodiment showing a resilient member is squeezed between a stopper ridge and a cap shoulder for generating a biasing force to the sheltering cap.

Meanwhile, in order to secure the durable and reliable performance, the fuel supply arrangement 30" comprises a resilient member 38" disposed between the transverse stopper ridge 371" and the cap shoulder 344" as shown in FIG. 11 and FIG. 12. As a result, during an ignition process, the upwardly proceeded sheltering cap 34" would clamp as well as squeeze the resilient member 38" between the stopper ridge 371" and the cap shoulder 344". After the user release the actuator, the biased resilient member 38" would be released thus forcing the cap shoulder 344" disengaged with the stopper ridge 371". That is to say, the resilient member 38" is purposed to retain the vertically shifted sheltering cap 34" always in serviceable position. After an ignition operation, the upwardly urged sheltering cap 34" would be homed back to an original position ready for next operation.

The resilient member 38" could be embodied as two springs downwardly extended from a bottom end of each stopper ridge 371", wherein the cap shoulder 344" is detachably and reciprocally engaged with the springs to be biased even bounced back. Or otherwise, the resilient member 38" is a coil spring sleeved onto the sheltering cap 34" and sustained by the cap shoulder 344. Therefore, once the sheltering cap 34" is upwardly shifted, the coil spring would be stuck between the stopper ridge 371" and the cap shoulder 344".

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighter, comprising:

a casing having a receiving cavity and an opening communicating said receiving cavity with outside;

a gas emitting nozzle appearing at a ceiling of said casing;

an ignition system supported by said casing for producing a spark toward said gas emitting nozzle;

two substantially rigid guiding walls supported within said casing, wherein each of said guiding walls has a transverse stopper ridge rigidly and integrally and inwardly defined thereon; and a fuel supply arrangement, which comprises:

a replaceable fuel cartridge detachably received in said receiving cavity through said opening for storing a liquefied fuel, wherein said replaceable fuel cartridge comprises a gas releasable valve coupling with said gas emitting nozzle for controlling a gas flow from said replaceable fuel cartridge;

a gas releasing lever, which is pivotally mounted on said replaceable fuel cartridge, having an actuating end coupled to said gas releasable valve for shifting a movement of said gas releasable valve and a driving end arranged when said driving end is depressed, said actuating end is pivotally actuated to shift said gas releasable valve for releasing said liquefied fuel from said replaceable fuel cartridge;

a gas releasing arrangement comprising an actuator movably supported within said casing to engage with said driving end of said gas releasing lever in such a manner that when said actuator is moved to depress said driving end of said gas releasing lever, said gas releasable valve releases gas to said gas emitting nozzle for being ignited;

a sheltering cap movably supported within said casing to detachably couple with said gas releasable valve when said replaceable fuel cartridge received in said receiving cavity, wherein said sheltering cap is slidably mounted between said guiding walls such that said guiding walls guides a movement of said sheltering cap when said sheltering cap is upwardly pushed by said gas releasable valve, wherein when said gas releasing valve is lifted up to push said sheltering cap upwardly, said stopper ridges block a further upward movement of said sheltering cap, wherein said sheltering cap further has a cap shoulder circularly projected from an outer wall of said sheltering cap, so that when said sheltering cap is upwardly shifted, said stopper ridges is arranged to bias against said cap shoulder so as to block said further upward movement of said sheltering cap; and at least a resilient member disposed between said transverse stopper ridge and said cap shoulder, wherein when said sheltering cap is upwardly shifted, said resilient member is squeezed between said stopper ridge and said cap shoulder so as to generate a biasing force facilitating said cap shoulder disengage with said stopper ridge after said actuator is released.

2. The lighter, as recited in claim 1, wherein said actuator comprises a lighter cap pivotally mounted to said casing for enclosing said ceiling of said casing and a driving lever having an upper portion coupling with said lighter cap and a lower portion slidably engaged with said driving end of said gas releasing lever such that when said lighter cap is pivotally and upwardly folded to expose said ceiling of said casing, said driving lever is driven to depress said driving end of said gas releasing lever for releasing said gas from said replaceable fuel cartridge.

3. The lighter, as recited in claim 1, wherein said fuel supply arrangement further comprises a gas transferring conduit extended from said sheltering cap to said gas emitting nozzle for guiding said gas released from said replaceable fuel cartridge to said gas emitting nozzle.

4. The lighter, as recited in claim 2, wherein said fuel supply arrangement further comprises a gas transferring conduit extended from said sheltering cap to said gas emitting nozzle for guiding said gas released from said replaceable fuel cartridge to said gas emitting nozzle.

5. The lighter, as recited in claim 1, wherein said sheltering cap, having an interior chamber detachably accommodating an operating tip of said gas releasable valve therein, is allowed to upwardly pushed to allow said gas releasable valve being lifted up for releasing said gas.

6. The lighter, as recited in claim 3, wherein said sheltering cap, having an interior chamber detachably accommodating an operating tip of said gas releasable valve therein, is allowed to upwardly pushed to allow said gas releasable valve being lifted up for releasing said gas.

7. The lighter, as recited in claim 4, wherein said sheltering cap, having an interior chamber detachably accommodating an operating tip of said gas releasable valve therein, is allowed to upwardly pushed to allow said gas releasable valve being lifted up for releasing said gas.

8. The lighter, as recited in claim 5, wherein said gas transferring conduit is a flexible gas tube allowing said gas to flow towards said gas emitting nozzle when said sheltering cap is pushed upwardly.

9. The lighter, as recited in claim 6, wherein said gas transferring conduit is a flexible gas tube allowing said gas to flow towards said gas emitting nozzle when said sheltering cap is pushed upwardly.

10. The lighter, as recited in claim 7, wherein said gas transferring conduit is a flexible gas tube allowing said gas to flow towards said gas emitting nozzle when said sheltering cap is pushed upwardly.

11. The lighter, as recited in claim 8, wherein said fuel supply arrangement further comprises a sealing member mounted in said interior chamber of said sheltering cap to sealedly mount to said gas releasable valve for preventing said gas leaking when an operating tip of said gas releasable valve is slidably inserted into said interior chamber of said sheltering cap.

12. The lighter, as recited in claim 9, wherein said fuel supply arrangement further comprises a sealing member mounted in said interior chamber of said sheltering cap to sealedly mount to said gas releasable valve for preventing said gas leaking when an operating tip of said gas releasable valve is slidably inserted into said interior chamber of said sheltering cap.

13. The lighter, as recited in claim 10, wherein said fuel supply arrangement further comprises a sealing member mounted in said interior chamber of said sheltering cap to sealedly mount to said gas releasable valve for preventing said gas leaking when an operating tip of said gas releasable valve is slidably inserted into said interior chamber of said sheltering cap.

14. The lighter, as recited in claim 11, further comprising means for applying an urging force against said gas releasing lever to push said actuating end thereof downwardly.

15. The lighter, as recited in claim 12, further comprising means for applying an urging force against said gas releasing lever to push said actuating end thereof downwardly.

16. The lighter, as recited in claim 13, further comprising means for applying an urging force against said gas releasing lever to push said actuating end thereof downwardly.

* * * * *